US009993706B2

(12) United States Patent
Kellam

(10) Patent No.: US 9,993,706 B2
(45) **Date of Patent: *Jun. 12, 2018**

(54) GOLF TEE WITH SPARK INDUCTION COATING AND METHOD FOR IMPROVING GOLF PERFORMANCE

(71) Applicant: John A. Kellam, Basking Ridge, NJ (US)

(72) Inventor: John A. Kellam, Basking Ridge, NJ (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/348,155

(22) Filed: Nov. 10, 2016

(65) Prior Publication Data

US 2017/0056734 A1 Mar. 2, 2017

Related U.S. Application Data

(63) Continuation-in-part of application No. 14/757,188, filed on Dec. 2, 2015, now Pat. No. 9,526,959, which (Continued)

(51) Int. Cl.

| | |
|---|---|
| ***A63B 57/10*** | (2015.01) |
| ***A63B 69/36*** | (2006.01) |
| *A63B 71/06* | (2006.01) |

(52) U.S. Cl.

CPC ..... *A63B 57/10* (2015.10); *A63B 69/36* (2013.01); *A63B 69/3617* (2013.01); *A63B 2071/0625* (2013.01); *A63B 2207/00* (2013.01)

(58) Field of Classification Search

CPC ..... A63B 57/10; A63B 69/3617; A63B 69/36; A63B 2208/00; A63B 2071/0625

See application file for complete search history.

(56) References Cited

U.S. PATENT DOCUMENTS 1,641,155 A * 9/1927 Clausing ..... A63B 57/10 473/402
1,645,001 A * 10/1927 Hodges ..... A63B 57/10 111/99

(Continued)

FOREIGN PATENT DOCUMENTS

WO WO 2008/013378 1/2008 ..... A63B 57/00
WO WO 2011078469 6/2011 ..... A63B 57/00

OTHER PUBLICATIONS

"Univeristy of Pittsburg Safety Manual: Subject: Combustible Metals", Sep. 10, 2013, retrived on May 8, 2015, http://ehs.pitt.edu/assets/docs/combustible-metals.pdf pp. 1-7.

(Continued)

*Primary Examiner* — Steven Wong
(74) *Attorney, Agent, or Firm* — Ernest D. Buff & Associates, LLC; Ernest D. Buff, Esq.; Margaret A. LaCroix

(57) ABSTRACT

A golf tee having a contact alert coating cooperates with a golf ball and a golf club to provide a novel training aid that is economical, compact, and encourages proper golfing form. The golf tee has a golf tee body with a top plate, top wall and side walls. The top plate is fixedly attached to a shaft which terminates into a point that is inserted into a ground surface when a ball is placed on the top plate. A contact alert coating is coated on at least an upper portion of the golf tee body. The contact alert coating is composed of a material that generates a spark and, preferably, an audible sound when a golf club head strikes the ball and strikes the contact alert coating of the golf tee at the coating/golf tee interface. Generation of the spark and, preferably, the audible sound provides an alert that immediately informs the user whether the user's golf swing has been properly executed.

20 Claims, 7 Drawing Sheets

Related U.S. Application Data is a continuation of application No. 13/694,591, filed on Dec. 14, 2012.

(56) References Cited

U.S. PATENT DOCUMENTS

| | | | | |
|---|---|---|---|---|
| 3,435,554 | A | 4/1969 | Philips | 446/22 |
| 3,947,027 | A | 3/1976 | Brown | 473/278 |
| 3,992,011 | A | 11/1976 | Jessee | 473/268 |
| 4,131,280 | A | 12/1978 | Poortman | 473/199 |
| 4,898,389 | A | 2/1990 | Plutt | 473/223 |
| 5,085,431 | A | 2/1992 | Mcguire | 473/386 |
| 5,120,358 | A | 5/1992 | Pippett | 106/31.01 |
| 5,356,146 | A | 10/1994 | Blosser | 473/400 |
| 5,597,361 | A | 1/1997 | Hope | 473/237 |
| 5,830,077 | A | 11/1998 | Yavitz | 473/226 |
| 5,890,976 | A | 4/1999 | Anderson | 473/398 |
| 6,309,315 | B1 | 10/2001 | Adams | 473/387 |
| 6,319,156 | B1 | 11/2001 | Alexsen | 473/339 |
| 6,832,964 | B2 | 12/2004 | Adams et al. | 473/387 |
| 7,169,067 | B2 | 1/2007 | Town | 473/417 |
| 7,604,554 | B2 | 10/2009 | Otsubo | 473/387 |
| D607,068 | S * | 12/2009 | Jones | D21/718 |
| 7,959,525 | B1 | 6/2011 | Brown | 473/387 |
| 8,083,615 | B2 | 12/2011 | Wood et al. | 473/387 |
| 9,526,959 | B2 * | 12/2016 | Kellam | A63B 57/10 |
| 2004/0162153 | A1 | 8/2004 | Adams et al. | 473/237 |
| 2005/0101413 | A1 | 5/2005 | Adams et al. | 473/387 |
| 2005/0127630 | A1 | 6/2005 | Kuhlman | 280/87.042 |
| 2009/0143159 | A1 | 6/2009 | Murph et al. | 473/239 |
| 2011/0256963 | A1 | 10/2011 | Goodwin | 437/387 |
| 2012/0065000 | A1 | 3/2012 | De Lisle | 473/387 |
| 2013/0165273 | A1 | 6/2013 | DeLisle | 473/399 |

OTHER PUBLICATIONS

Chang, Jon, "Titanium Golf Clubs Can Toss 3,00-Dergree Sparks", http://abcnews.go.com/Technology/titanium-golf-clubs-toss-3000-degree-sparks/story?id=22973386 retrieved on Jun. 25, 2014.

* cited by examiner

GOLF TEE WITH SPARK INDUCTION COATING AND METHOD FOR IMPROVING GOLF PERFORMANCE

This is a Continuation-In-Part of U.S. application Ser. No. 14/757,188 filed Dec. 2, 2015 which, in turn, is a Continuation-In-Part of U.S. application Ser. No. 13/694,591 filed Dec. 14, 2012 for "Golf Tee with Spark Induction Coating and Method for Improving Golf Performance", the disclosures of which are hereby incorporated in their entirety by reference thereto.

BACKGROUND OF THE INVENTION

1. Field of the Invention

The present invention relates to golfing devices and methods; and more particularly, to golfing devices and methods that are designed to perfect a golfer's swing, increase ball contact and improve golf performance.

2. Description of the Prior Art

The sport of golfing has become a major entertainment and business industry. Frequently business meetings and dealings take place on the golf course. Social events and outings often are carried out on golf courses. Consequently, individuals of all golfing levels frequently search for methods and devices to improve their golf game. Notwithstanding the plethora of such methods and devices, the improvement of golf prowess can be challenging. Golfers have long known that a proper golf swing is an important component of good golfing technique. Extra care must be taken by the golfer to ensure optimal stroke carry through. A necessary prerequisite for proper golf form is the requirement that a golfer keep his head down during the swing. This condition is actually quite challenging in that golfers frequently forget to keep their head facing downward during the swing and, in doing so, overlook an important swing requirement. Without proper form a tee shot is much less likely to find the fairway.

Golf outings represent a form recreational sporting activity; but additionally provide opportunities to improve business relations, develop inter-company networking and conduct business transactions. For many golfers, the desire to increase performance cannot be understated. While various training devices and methods have been disclosed and utilized, many of these devices and methods are complicated and costly.

Numerous methods and devices have been proposed that attempt to improve a golfer's performance. Such devices and methods are summarized herein below.

U.S. Pat. No. 3,435,554 to Philips discloses a sparking hammer generally having a lower head portion provided with an external bellows, to which is secured a plate. A striker bar, serrated on its exterior, frictionally engages flint secured to the oscillating extension of a spring in order that it will engage the serrations of the striker bar, when the bellows of the lower head portion strikes a surface.

U.S. Pat. No. 3,947,027 to Brown discloses a high performance golf tee having a stem, a cup-shaped ball receptacle on the top of the stem, and a projection extending outwardly from the ball receptacle. The extension distance is such that when a golf ball is placed on the tee and a golf club is swung at the ball, the golf club contacts the projection and imparts motion to the ball before the golf club makes direct contact with the surface of the golf ball. The contact between the golf club and the projection imparts an initial backspin on the ball.

U.S. Pat. No. 3,992,011 to Jessee discloses a heads down golf practice device having a resilient tubular golf tee member mounted in and protruding upwardly from a resilient, flat tee support structure base. The base includes a light emitting assembly having a light visible through the interior portion of the resilient tubular golf tee and mechanical indexing elements for randomly selecting a color of the visible light. It does not teach or discloses a golf tee having a contact alert coating.

U.S. Pat. No. 4,131,280 to Poortman discloses an electronic tee off device having a plurality of light-emitting diodes of different colors. These diodes are situated at a location where, when energized, they are visible to a golfer when the golfer is properly positioned with respect to a golf ball appointed to be driven from a tee.

U.S. Pat. No. 4,898,389 to Plutt discloses a self-contained gold training device designed to be integral with, or attached to and detached from the head of any golf club. The device gives a golfer an exact indication of the point of impact of the face of a golf club with a golf ball.

U.S. Pat. No. 5,085,431 to McGuire discloses a golf tee providing a pliant riser and a rigid anchor. A placement tool providing means for placement of said golf tee into the ground. The anchor having enough length and exposed surface area to provide the required friction needed to hold said golf tee firmly in place even after being struck by a golf club used to hit a golf ball teed up on said golf tee. The placement tool consisting of a tool handle, a tool shaft and a tool sleeve is used to place said golf tee into the ground such that the anchor head is below the ground surface a distance calibrated by the tee height indicator on the riser. There is no disclosure of a coating on the placement tool, which is utilized for placing a golf tee into the ground. Furthermore, the placement tool and golf tee do not emit a spark that immediately indicates proper golf stroke form.

U.S. Pat. No. 5,120,358 to Pippett discloses that determination of the point of impact on a golf club face with a golf ball is facilitated through the use of a flowable chalk compound placed on the ball at the intended point of contact with the club face. The flowable chalk compound includes a homogeneous, paste-like mixture of a major proportion of a solid, finely divided pigment and a minor proportion of a grease-like material. Upon impact, the chalk compound will make a visible mark on the club head face that may be observed by the golfer. There is no disclosure of a coating on the golf tee. Instead the chalk compound is placed on the ball. Furthermore, the chalk compound does not provide immediate feedback concerning of the golf club stroke, since the club head face must be observed after the golf swing in order to discern the point of contact between the club head and the ball.

U.S. Pat. No. 5,356,146 to Blosser discloses a golf tee having successive contrasting color stripes around most of its length. A golfer can determine at a glance how many of the stripes are exposed above the ground in which the tee is set, and thereby determine the height of a golf ball on the tee above the ground. The stripes are arranged in repeated sequences with two or more different colors in each sequence.

U.S. Pat. No. 5,597,361 to Hope discloses a self-adhesive indicator which adheres to a golf club face to provide an indication of the point of impact of the golf ball on the club face. The indicator consists of a sandwich of various layers—a layer of pressure-sensitive adhesive on the bottom, followed by a layer of energy-absorbing elastomeric material on which is provided a film of a thermochromic material such as a temperature sensitive liquid crystal, followed by a top layer of clear high impact plastic.

U.S. Pat. No. 5,830,077 to Yavitz discloses a device for assisting a golfer in improving his or her golf swing. The device includes an impact detector mounted to the club head of a golf club. The impact detector provides an instantaneous visual or audible indication of when a predetermined area, e.g., the "sweet spot", of the club head face strikes the golf ball. There is no disclosure of a coating on the golf tee. Instead the impact detector is mounted to the club head. Modifying the golf club head by mounting the impact detector thereon would disqualify the golf club and lead to stroke penalties if the club were used in recreational and tournament play. Standard regulated golf clubs and golf balls must be unadulterated or un-manipulated as required under golf organization rules and regulations of the United States Golf Association (USGA).

U.S. Pat. No. 5,890,976 to Anderson discloses an encasement device for a golf tee cylindrically adhered to a shaft of golf tee. The encasement device is a cover with graduated markings, which allow the golfer to consistently set the tee at the golfer's desired depth. Each graduated marking is numerically related to other graduated markings and the ground penetration depth. The resulting multi-layer structure of the golf tee and the encasement device deters breakage of the golf tee and reinforces the shaft structure of the golf tee.

U.S. Pat. No. 6,319,156 to Alexsen discloses a biodegradable golf tee having fertilizer properties, as well as a method of making the golf tee.

U.S. Pat. No. 6,832,964, U.S. Patent Application Publication Nos. 20040162153 and 20050101413 to Adams et al. disclose a golf tee coated with colored coatings which, when struck with a golf club, leave a marking that easily identifies where the ball was struck on the club face and the path of the swing, but does not come off in normal handling. The tee leaves a multi-colored marking on the club face that is used to show the swing path of a golfer's swing and the point of impact of the tee on the face of the golf club. There is no disclosure of a spark coating on the golf tee. Instead a colored coating compound leaves a mark on the golf club face. Furthermore, the colored coating does not provide immediate feedback regarding the golf club stroke, since the club head face must be observed after the golf club swing in order to discern the point of contact.

U.S. Pat. No. 7,169,067 to Town discloses a swing training device. A microprocessor controlled set of colored LEDs teach the user to watch the ball during contact by a ball hitting device such as a baseball bat or golf club.

U.S. Pat. No. 7,604,554 to Otsubo discloses a golf tee implementing an anchoring device, an impact energy deflection device and a friction reduction device in one-piece configuration. The tee anchoring device comprises two anchoring fins for initial impact resistance and the recoil dislodgement prevention fin after-impact resistance.

U.S. Pat. No. 7,959,525 to Brown discloses a dual composition polymeric device to be used as a golf tee. The device has a polymeric hollow stiff stem portion with an integral cone portion at its top end; a cone-shaped polymeric flexible face portion mechanically joined to the cone and stiff stem portion; an internal air passage through the center of the cone-shaped flexible face; and a removable mechanical screw joining the cone-shaped flexible face portion with the stiff stem portion and its integral cone portion.

U.S. Pat. No. 8,083,615 to Wood et al. discloses a set of golf tees. The set includes at least a low spin golf tee and a high spin golf tee. The low spin golf tee is constructed to provide decreased resistance to the deformation of a golf ball that is impacted by a golf club while resting on the low spin golf tee.

U.S. Patent Application Publication No. 20050127630 to Kuhlman et al. discloses a spark-emitting device for a skateboard. The spark-emitting device includes a housing and a plurality of misch metal barrels inserted into a housing and spaced apart so that the wear rate of the housing in the misch metal barrels is compatible and a desired sparking effect is achieved. The spark-emitting device for a skateboard is not utilized for golf purposes; no disclosure is contained therein regarding a spark-emitting tee for golf play.

U.S. Patent Application Publication No. 20090143159 to Murph et al. discloses a golf club that provides a universal training tool for golfers of all sizes. The golf club includes an adjustable length shaft having a club head secured at one end thereof and a handle secured at the other end thereof. A sensor circuit disposed in the club head includes a first sensor adapted to generate and transmit a first measurement signal representing a first desired characteristic of the golf club, and a display circuit disposed in the handle.

U.S. Patent Application Publication No. 20130165273 to Delisle et al. discloses a golf tee including an elongate shaft having opposed upper and lower ends, the lower end configured to be inserted into an underlying surface; and a support cup that is configured to support a golf ball from beneath and that merges with the shaft. The support cup has a base portion and further includes at least three arcuate support prongs projecting upwardly from the base portion. The support prongs define a discontinuous annulus about the periphery of the support cup. There is no disclosure of a spark induction coating on the golf tee. Inasmuch as no spark is generated, the golf tee does not provide immediate feedback regarding the golf club stroke.

Foreign Patent Publication No. WO/2011/078469 to Ru discloses a golf tee that prevents the golfer from raising his head up. The golf tee construction comprising inter alia a light emitting lamp built in a laid portion.

None of the heretofore disclosed and/or utilized devices or methods provides a golf tee for a training aid including a golf ball and a golf club that is economical to produce, easy to use and reliably assists a golfer to achieve proper golfing form. Specifically, none of the heretofore disclosed and/or utilized devices or methods provides a golf tee that is inexpensive to construct, reliable in operation, and provides a readily accessible and entertaining way to improve one's golf swing and provide immediate evidence of the optimal stance and follow through required for proper swing form.

There exists a need in the art for a device or method that provides a low cost, reliable golf tee for use with a golf ball and a golf club that is easy to use and assists a golfer to achieving proper golfing form. In addition, there exists a need in the art for a golf tee that is inexpensive to construct, accurate and reliable in operation, and provides a readily accessible and entertaining way to improve one's golf swing and provide immediate evidence of the optimal stance and follow through required for proper swing form. Further, there is a need in the art to provide a golf tee achieving these features that can be used in compliance with rules and regulations of golf courses and tournaments, for use with standard regulation golf clubs and golf balls.

SUMMARY OF THE INVENTION

The present invention provides a golf tee for use with a golf ball and a golf club, the golf tee having a contact alert coating that generates a spark when struck with a golf club, thereby providing an alert that immediately informs the user whether the user's golf swing has been properly executed. The golf tee, when used with the golf ball and golf club provide a novel training aid that is economical, compact, and encourages proper golfing form.

The subject golf tee comprises a golf tee body having a top plate with a top wall and side walls, the top plate being fixedly attached to a shaft. The shaft terminates into a point appointed for insertion into a ground surface. A ball is placed on the top plate. A contact alert coating is coated on at least a portion of the golf tee body. The contact alert coating is composed of a material adapted to generate an alert when a golf club head strikes the ball and the contact alert coating of the golf tee at the coating golf tee interface. More specifically, the material of the contact alert coating is a spark inducing composition or a spark and sound generating composition. When used with a golf ball and golf club that do not have a contact alert coating thereon, the contact alert coating located on the golf tee generates an alert when struck by the golf club head, thereby immediately informing the user whether the user's golf swing has been properly executed.

The subject golf tee is especially well suited for use with a golf ball and a golf club to provide an economical and compact training aid that encourages proper golfing form. The golf tee comprises (i) a golf tee body having a top plate with a top wall and side walls, the top plate being fixedly attached to a shaft which terminates into a point, the point and a portion of the shaft being appointed to be inserted into a ground surface when a golfer is getting ready to tee off, and a golf ball appointed to be placed on the top wall of the top plate; (ii) a contact alert coating disposed on at least a portion of the top plate but not located on the ball and not located on the head of the golf club; (iii) the contact alert coating being composed of a combustible material for generating a spark and, preferably, an audible noise upon contact of a golf club head as the club head strikes the ball and contacts the contact alert coating of the golf tee at the coating golf tee interface; and (iv) the contact alert coating having a depth ranging from 0.001 inches to 1.0 inches.

When struck by the head of a golf club, the contact alert coating located on the subject golf tee contemporaneously generates an alert in the form of a spark, thereby immediately informing the user as to whether the user's golf swing has been properly executed. Proper golfing form is promoted by encouraging the golfer to see the spark and by so doing keep his head in the downward facing position throughout the golf swing. A golfer simply tees-up the ball in the usual way.

Advantageously, the subject golf tee does not require any alterations to the designs of either the golf ball or the golf club, which would adversely affect the trajectory of the ball. Additionally, information regarding proper golfing form is provided immediately, during the golf swing, when the golf club head strikes the ball, thereby improving muscle memory required to reliably replicate a proper golf swing. The golf tee can be used in compliance with rules and regulations of golf courses and tournaments as it is for use with standard regulated golf clubs and golf balls that are unadulterated or un-manipulated as required under golf organization rules and regulations of the United States Golf Association (USGA).

BRIEF DESCRIPTION OF THE DRAWINGS

The invention will be more fully understood and further advantages will become apparent when reference is had to the following detailed description of the preferred embodiments of the invention and the accompanying drawing, in which.

DETAILED DESCRIPTION OF THE INVENTION

Figure 1:
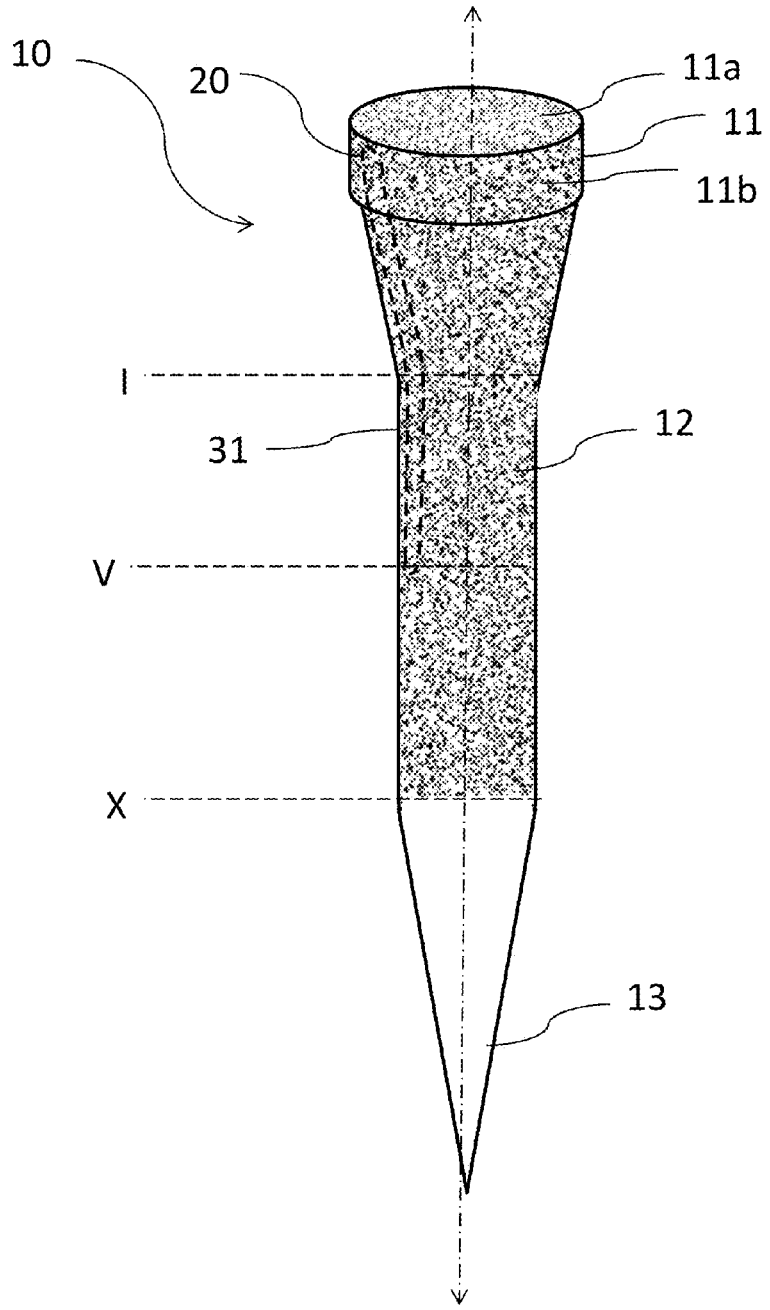
FIG. 1 illustrates a plan view of an embodiment of the subject golf tee.

This invention relates to a golf tee having a contact alert coating, and a method of using a golf tee, that sparks only, or in an alternative embodiment sparks and makes an audible sound upon being struck by a golf club. In particular, the subject invention is directed towards a golf tee especially suited for use with a golf ball and a golf club. The golf tee has a contact alert coating, preferably a spark inducing coating, and broadly comprises: (i) a golf tee body having a top plate with a top wall and side walls, the top plate being fixedly attached to a shaft which terminates into a point, the point and a portion of the shaft being appointed to be inserted into a ground surface when a golfer is getting ready to tee off, and a golf ball is placed on the top wall of the top plate; (ii) a contact alert coating disposed on at least a portion of the top plate but not located on the ball and not located on the head of the golf club; (iii) the contact alert coating composed of a combustible material for generating a spark upon contact of a golf club head as the club head strikes the ball and contacts the contact alert coating of the golf tee at the coating golf tee interface; and (iv) the contact alert coating having a depth ranging from 0.001 inches to 1.0 inches. Alternatively the coating generates both a spark and an audible sound.

When struck by the head of a golf club, the contact alert coating located on the subject golf tee generates an alert in the form of a spark (or a spark with an audible sound, such as a snap or bang), thereby immediately informing the user as to whether the user's golf swing has been properly executed. Proper golfing form is promoted by encouraging the golfer to keep his head in the downward facing position throughout the golf swing. A golfer simply tees-up the ball in the usual way.

Advantageously, the subject golf tee does not require any alterations to the designs of either the golf ball or the golf club, which would adversely affect the trajectory of the ball. Additionally, information regarding proper golfing form is provided immediately, during the golf swing, when the golf club head strikes the ball, thereby improving muscle memory required to reliably replicate a proper golf swing. The golf tee can be used in compliance with rules and regulations of golf courses and tournaments as it is for use with standard regulation golf clubs and golf balls that are unadulterated or un-manipulated as required under golf organization rules and regulations of the USGA.

The golf tee body with its attached shaft is appointed to be inserted into the ground. The contact alert coating is coated on at least an upper portion of the golf tee body, said coating being composed of a combustible material (preferably a spark inducing composition or a spark and sound generating composition) that will generate an alert when struck by a golf club. Therefore, when a user's golf club head strikes the ball and strikes the contact alert coating of the Golf Tee at the coating/Golf Tee interface, an alert is generated thereby immediately informing the user if a golf swing has been properly executed.

Significantly, the alert produced by the contact alert coating of the subject golf tee is generated, reliably relayed to, and received by the user at the point of impact between the club head and the ball (during the golf swing); not after the golf swing has occurred. Instantaneous feedback is provided, thereby improving muscle memory required to reliably replicate a proper golf swing. No alterations are required to the designs of either the golf ball or the golf club, which would adversely affect the trajectory of the ball. Any alterations of the golf ball and/or golf club could also render the ball and club as falling outside of golf rules and regulations, and would likely cause a player to be disqualified in tournaments and league matches.

Advantageously, the subject golf tee device does not require any alterations to the design of the golf ball or golf club, which would adversely affect the trajectory of the ball. Further, it is considerably less expensive and more efficient to place an alert coating on a golf tee, rather than on each and every golf ball being used. Still further, the immediate feedback provided by generation of an alert when the club head contacts the golf ball/golf tee interface constitutes a necessary prerequisite for connoting proper correlation of the arms, torso and legs during the golf swing, to establish the muscle memory required to reliably replicate a proper golf swing and thereby achieve proper golfing form. By having the coating solely on the tee of the subject golf tee, but not on the ball or on the club head face, immediate feedback during the swing (not afterwards) is provided that helps the player lock in the proper swing mechanics, keep his head down, and improve his/her golf swing. These advantages are achieved without causing the user/golfer to be disqualified during a round or golf tournament or game.

Uniquely, the subject golf tee is especially well suited for use with a golf ball and golf club to provide a training aid that is fun to use and entertaining, as well. Proper golfing form is promoted by encouraging the golfer to keep his head in the downward facing position throughout the golf swing. When using the subject golf tee with spark induction coating, a golfer simply tees-up the ball in the usual way. The tee is coated with a substance such as ground-up asphalt, small metallic pieces (for example magnesium; zirconium), gunpowder, black powder, flint, aluminum, aluminum fines, flitter, or granules, and iron; or other substances that are prone to sparking when contacted by the head of a golf club swung at approximately 100 mph. Typically a binding agent is used, such as a starch or sugar, wherein the metallic pieces are mixed and coated on the golf tee. Colors, including gold, red, green and blue, for example, can be utilized in combination with the substance which, in turn, may be a combustible material, preferably a gunpowder type material consisting of sodium and/or potassium nitrates (or chlorates) with sulfur and carbon, and powdered metals such as iron, aluminum, or magnesium. Preferably, the coating applied to the golf tee is coated with paraffin wax to prevent oxidation during storage. By adding nitrate or chloride salts of strontium (red), barium (green) and copper (blue), colors are produced with the spark.

The coating may include flint-like material that emits sparks on contact with force, such as that exhibited via the golf club head. The flint-like material may be a mischmetal material or combinations thereof. Mischmetal, rare earth mischmetal or misch metal is an alloy of rare earth elements. Its most common use is in the ferrocerium "flint" ignition device of many lighters and torches, although an alloy of only rare-earth elements would be too soft to give good sparks. Preferably the subject coating is made up of a mischmetal composition including approximately 50% cerium and 25% lanthium and small amounts of neodymium and praseodymium blended with iron oxide and magnesium oxide to form a harder material known as ferrocerium.

Preferably, the coating is non-flammable in nature to mitigate fire risks. In one embodiment, the golf tee is coated with a thin layer of a mixture containing potassium chlorate, sulfur, glue and powdered glass (silica) to produce a spark when hit by a high silica-containing substance. This surface coating may be sprayed on the golf tee via aerosol.

The velocity of the golf club head and the substance with which the tee is coated interacts to create a sparking effect at various club head speeds ranging from about 70 to 120 mph. Different substances can be used to create different spark colors, and the substance can be designed to work even when the grass within which the tee is inserted becomes damp or wet with dew. Upon contact with a golf club, the tee will spark; a golfer witnessing the sparking action is thereby informed that the golf swing has been properly executed.

Figure 2:
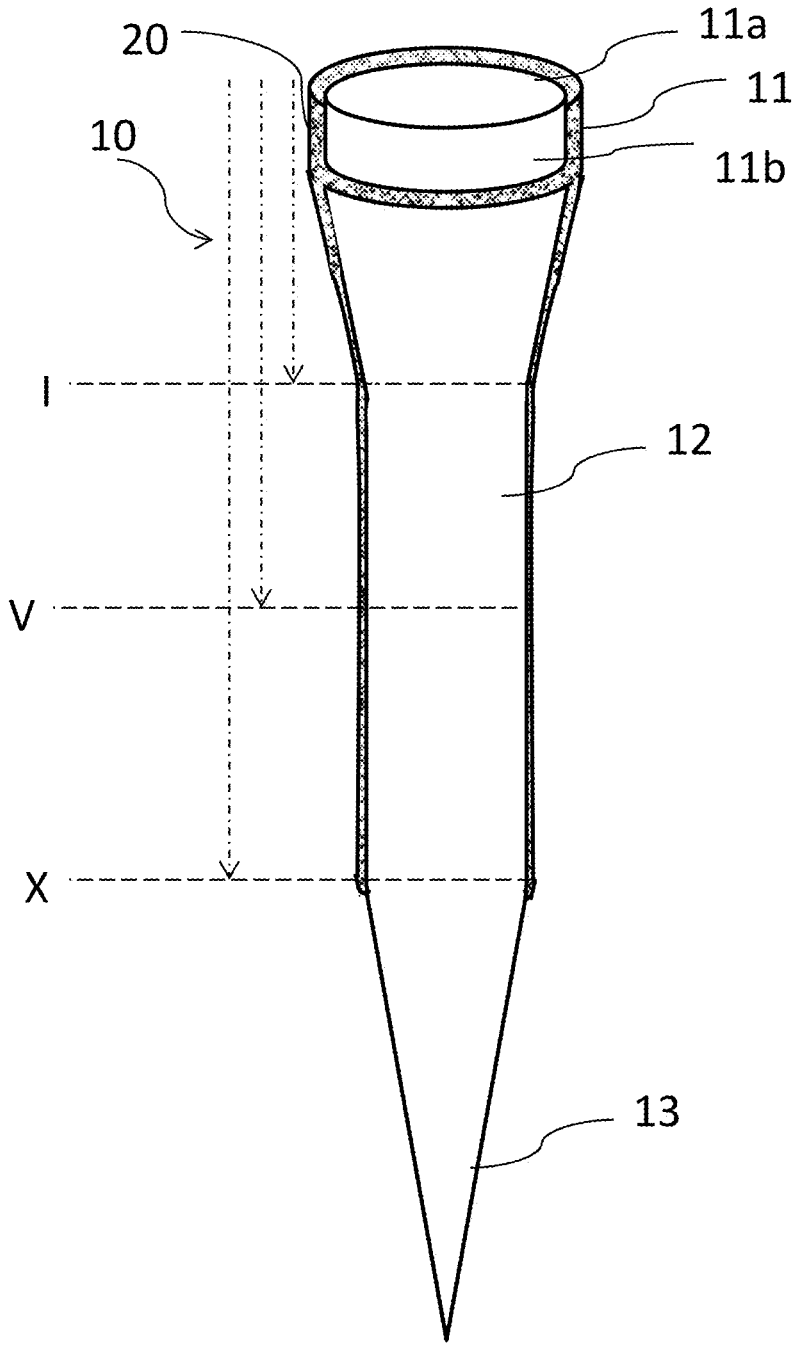
FIG. 2 illustrates a cross-sectional view taken along line x-x in FIG. 1.
Figure 3:
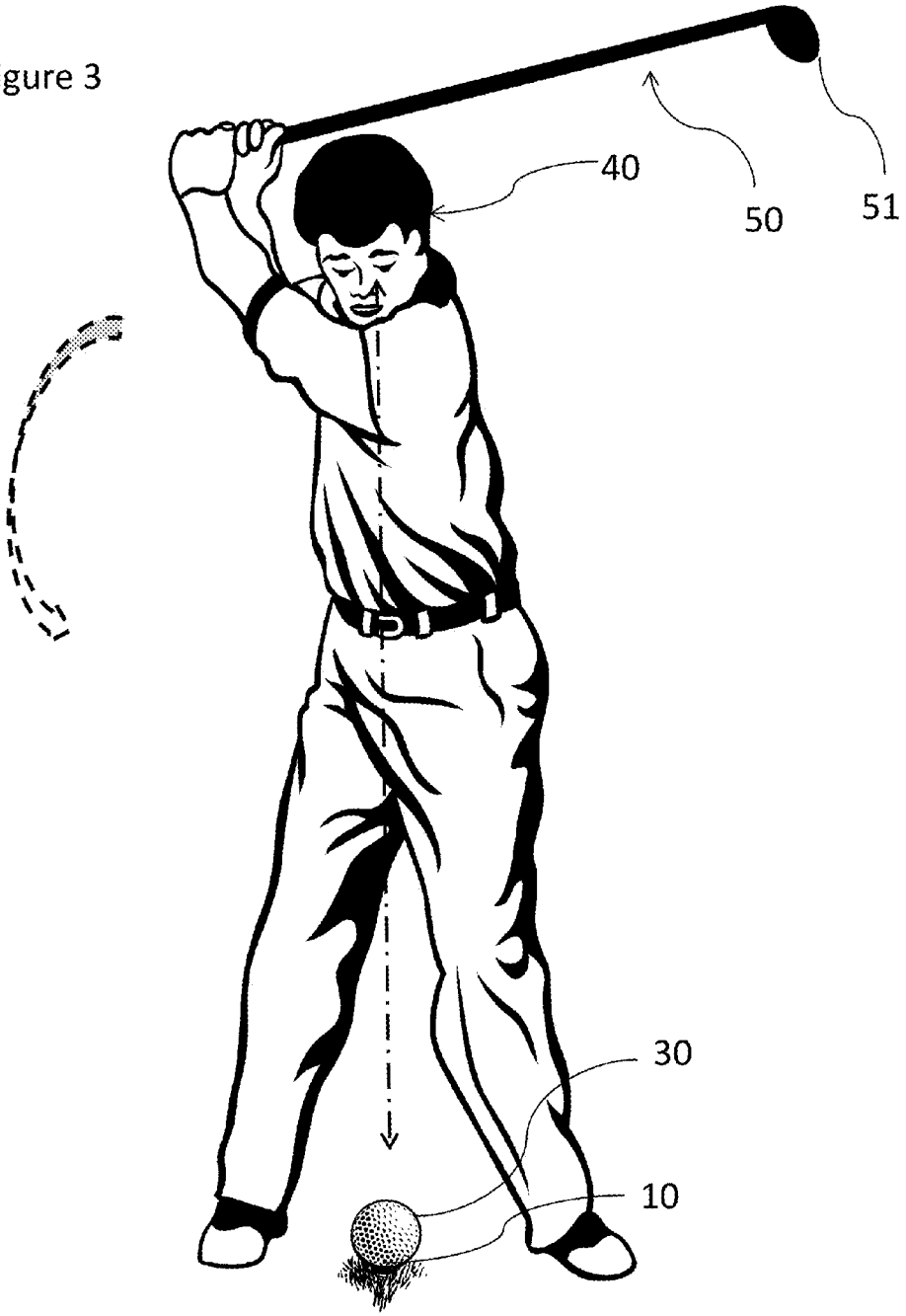
FIG. 3 illustrates a view of an embodiment of the golf tee in use with a golfer getting ready to tee off in proper form.
Figure 4:
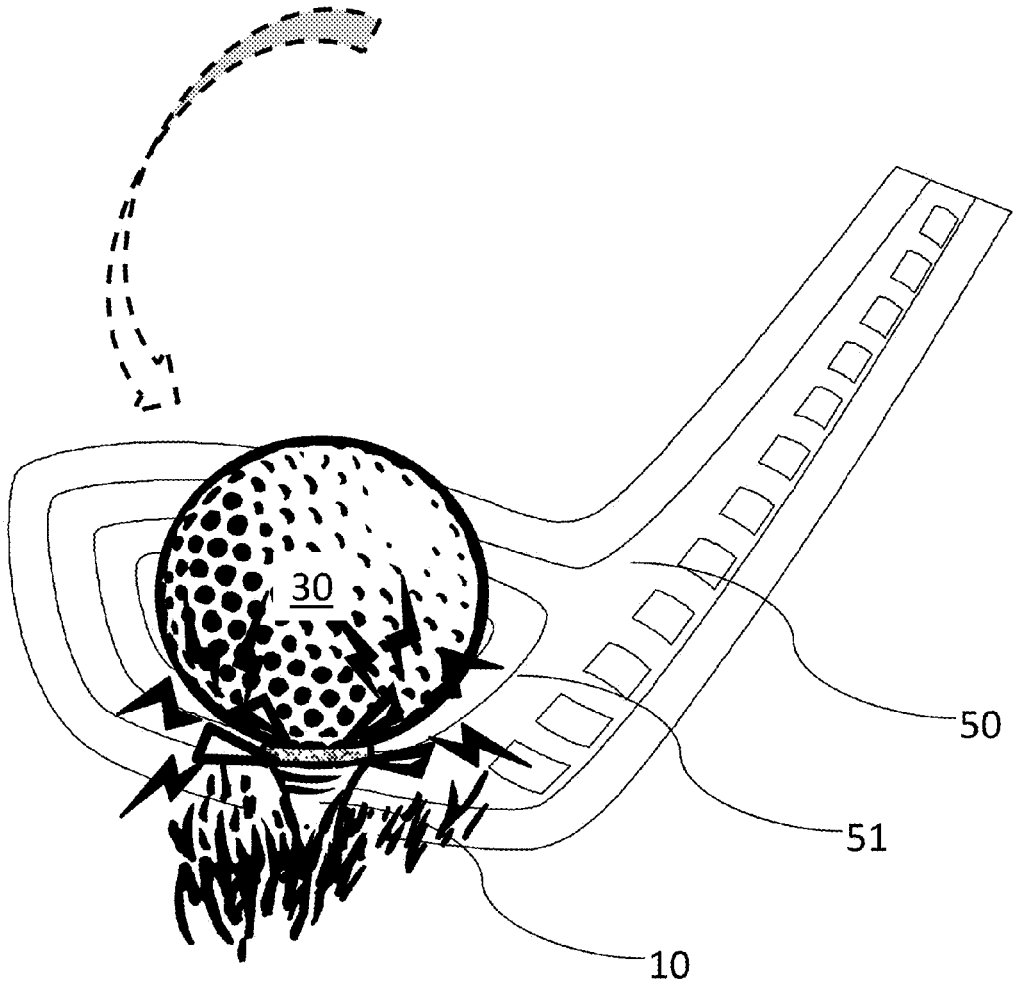
FIG. 4 illustrates a view of an embodiment of the golf tee in use, showing impact of a club head with the golf tee, and a spark generated from the coating on the golf tee.

The subject spark inducing golf tee, and method of use thereof, provides a novel training aid that is economical, compact, and encourages proper golfing form. FIGS. 1-4 illustrate views of an embodiment of the subject golf tee. FIG. 1 illustrates a plan view of an embodiment of the golf tee; FIG. 2 illustrates a cross-sectional view taken along line x-x in FIG. 1; FIG. 3 illustrates a view of an embodiment of the golf tee in use with a golfer getting ready to tee off with proper form; and FIG. 4 illustrates a view of an embodiment of the golf tee in use with impact of a golf club and spark generation therefrom.

In referring to FIGS. 1-4, generally, the golf tee 10 has a size and shape of a typical golf tee. Golf tee 10 includes a top plate 11 with a top wall 11*a* and side walls 11*b*. Top plate 11 is fixedly attached to a shaft 12 which terminates into a point 13. Top plate 11 may have many different shape configurations, as illustrated in FIG. 7, which shows a top plan view of various top plate 11 configurations. Point 13 and a substantial portion of shaft 12 are inserted into the ground when a golfer is getting ready to tee off. A golf ball, as shown at 30 in FIGS. 3 and 4, is adapted to be placed on top of top plate 11. A contact alert coating 20 is applied to at least an upper portion of the golf tee 10. Preferably the contact alert coating 20 extends downward from the top of the tee to line I; alternatively, contact alert coating 20 extends downward to line V; in another embodiment, the contact alert coating 20 extends substantially down on the golf tee body to line X. When the powder/contact alert coating 20 extends further down the tee shaft (as to line V and/or X), it increases the chances for contact and spark ignition. Contact alert coating 20 is preferably a coating that generates a spark upon forceful contact of a golf club head 51 on the golf tee when a golf club 50 is swung so that head 51 strikes ball 30 and contacts golf tee 10 at the coating/golf tee interface. The golf club head 51 is unadulterated or un-manipulated so that it is in compliance with USGA rules and regulations. Contact alert coating 20 may optionally further include a snap sound generation upon the golf tee being struck by the unadulterated golf club head 51.

Contact alert coating 20 is preferably a non-flammable substance so that it does not pose a fire hazard. Further, the non-flammable coating 20 will not be subject to flammability when stored in the trunk of a vehicle and will not inadvertently be ignited. In one embodiment, the golf tee is coated with a thin layers of a mixture containing potassium chlorate, sulfur, glue and powdered glass (silica) to produce a spark when hit by a high silica-containing substance; this surface may be sprayed on the golf tee via aerosol. In another embodiment, the contact alert coating 20 is a substance such as ground-up asphalt, small metallic pieces (for example magnesium) or other substance that is prone to sparking when the coating of the golf tee is contacted by the head of a golf club swung at approximately 100 mph. The velocity of the golf club head and the substance with which the tee is coated interacts to create a sparking effect at various club head speeds ranging from about 70 to 120 mph. Different substances can be used to create different spark colors, and the substance can be designed to work even when the grass within which the tee is inserted becomes damp or wet with dew. Upon contact with a golf club, the tee will spark; a golfer witnessing the sparking action is thereby informed that the golf swing has been properly executed. In an alternative embodiment, a firecracker like coating may be applied in conjunction with or just under the spark coating layer so that if a fast speed (~100 mph) is used, there will also be a firecracker type sound effect, which signifies a very fast swing speed.

As illustrated in FIGS. 1 and 2, coating 20 may be located on at least a portion of the top wall surface 11*a* of top plate 11. Alternatively, coating 20 may be located on at least a portion of side walls 11*b* of top plate 11. Optionally, coating 20 may be located on both the side walls 11*b* and top wall 11*a* of the top plate 11. What is more, coating 20 may extend down a portion of shaft 12. The coating 20 preferably has a thickness of 0.001 to 1 inch. Preferably contact alert coating 20 extends downward from the top of the tee to line I; alternatively, contact alert coating 20 extends downward to line V; in another embodiment, the contact alert coating 20 extends substantially down on the golf tee body to line X. When the powder/contact alert coating 20 is further down the tee shaft (as to line V and/or X), it increases the chances for contact and spark ignition.

The subject golf tee 10 provides a training aid that is fun to use and entertaining, as well. Proper golfing form is promoted by encouraging the golfer to keep his head 40 looking in the downward facing position, as indicated in FIG. 3. The golfer 40 tees-up the ball in the usual way. As the golf club is swung at approximately about 70 to 120 mph and makes contact with the golf tee 10, the velocity of the golf club head and the coating interacts to create a sparking effect at various club head speeds. Upon contact with a golf club, the tee will spark; a golfer witnessing the sparking action is thereby informed that the golf swing has been properly executed.

Figure 5:
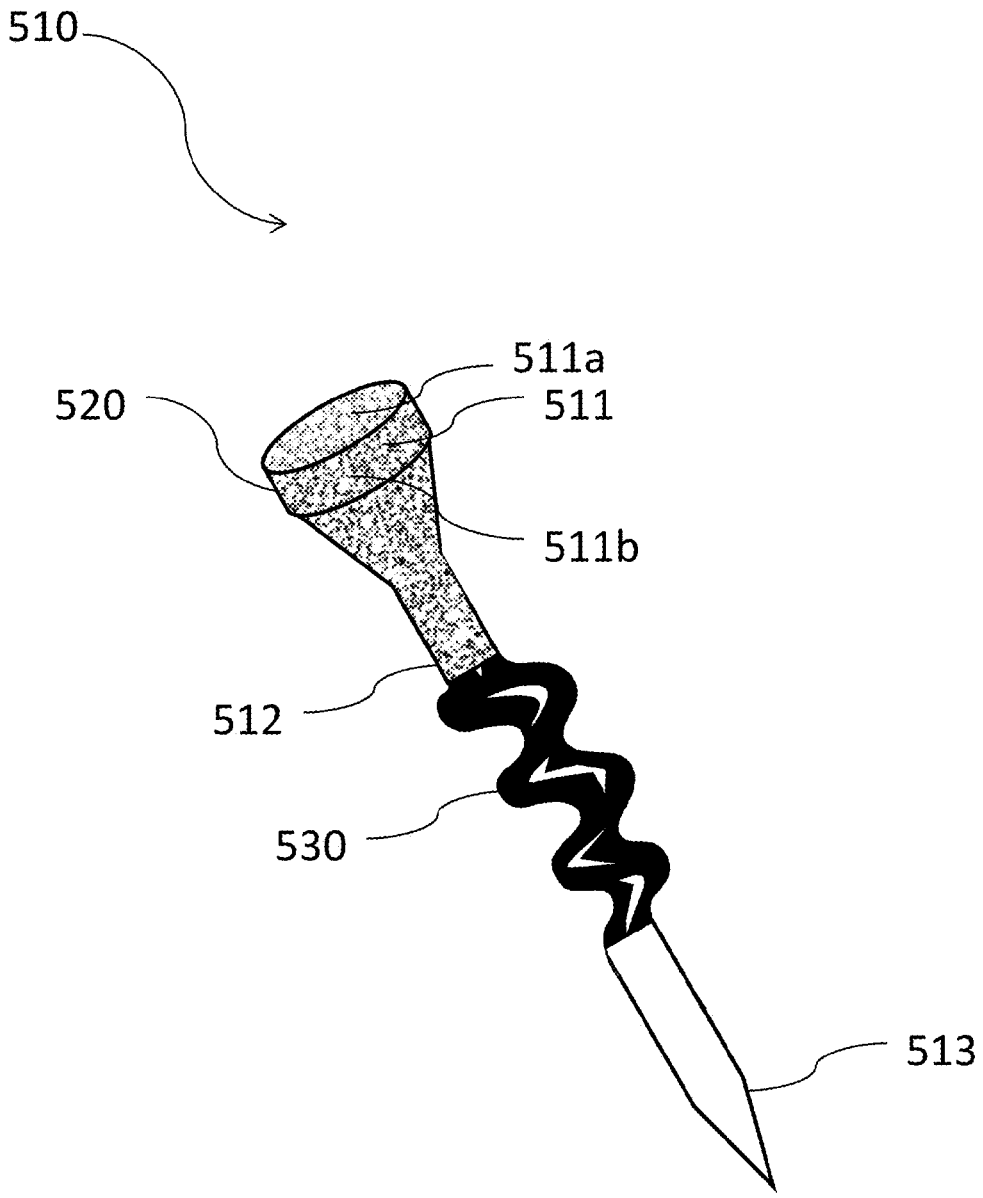
FIG. 5 illustrates a view of an embodiment of the golf tee wherein the golf tee has a spiral shaped body.

FIG. 5 illustrates a view of an embodiment of the golf tee wherein the golf tee has a spiral shaped body, shown generally at 500. In this embodiment the body of the tee is spiraled to assist in holding the tee in place and stabilizing the tee to ensure optimum contact force. Golf tee 510 includes a top plate 511 with a top wall 511*a* and side walls 511*b*. Top plate 511 is fixedly attached to a shaft 512 terminating at a spiral section 530, which in turn terminates into a point 513. Point 513 and a substantial portion of spiral section 530 and a portion of shaft 512 are inserted into the ground when a golfer is getting ready to tee off. A contact alert coating 520 is applied to at least an upper portion of the golf tee 510. Contact alert coating 520 is preferably a coating that generates a spark upon forceful contact of a golf club when it strikes the ball and contacts golf tee 510 at the coating/golf tee interface. Spiral section 530 has at least one spiral which acts to stabilize the tee in the ground for added contact force between the golf club and tee.

Figure 6A:
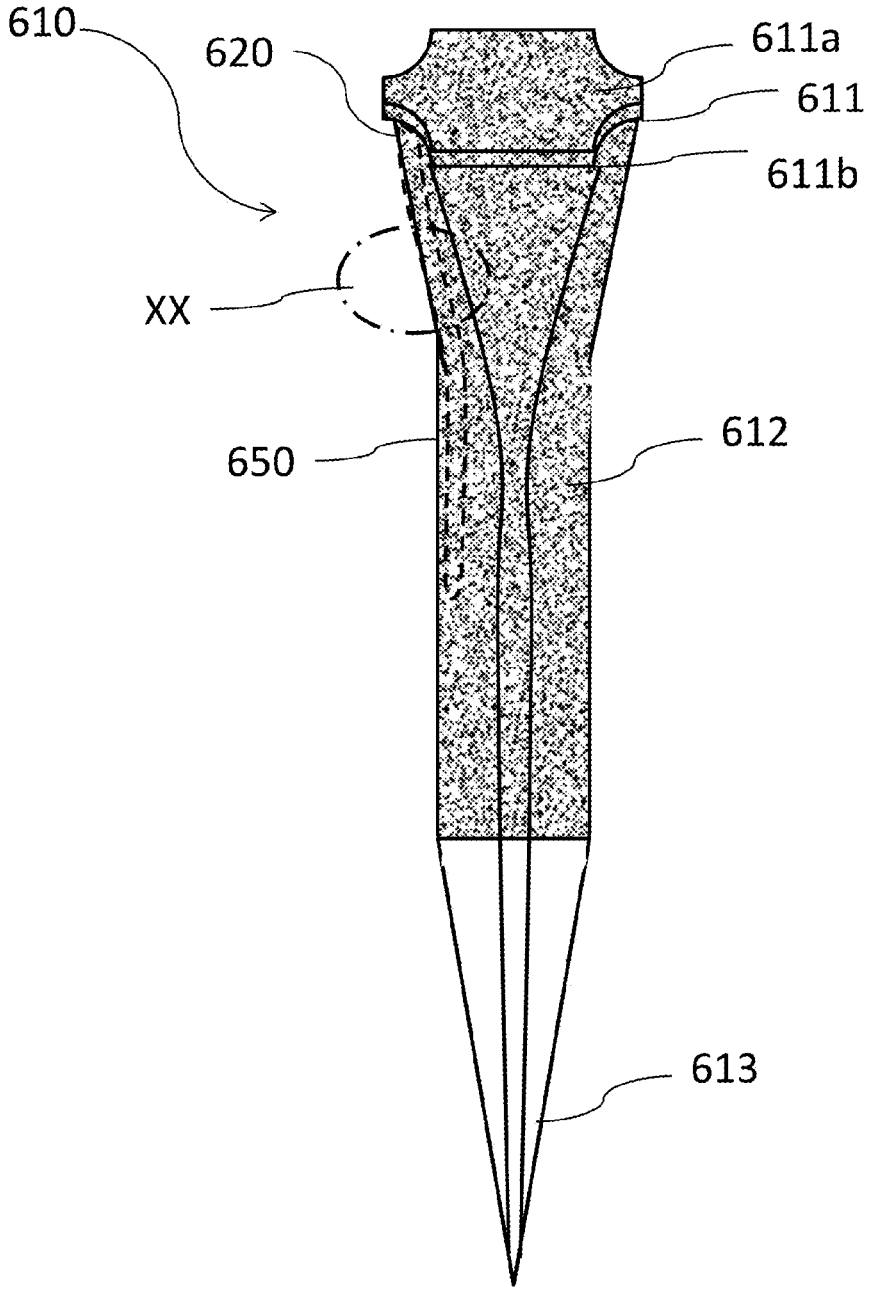
FIG. 6*a* illustrates a plan view of an embodiment of the subject golf tee wherein the golf tee is shaped having divots containing a higher concentration of spark inducing substance.
Figure 6B:
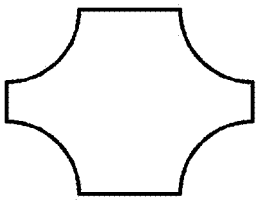
FIG. 6*b* illustrates a top view of the tee of FIG. 6*a*.
Figure 6C:
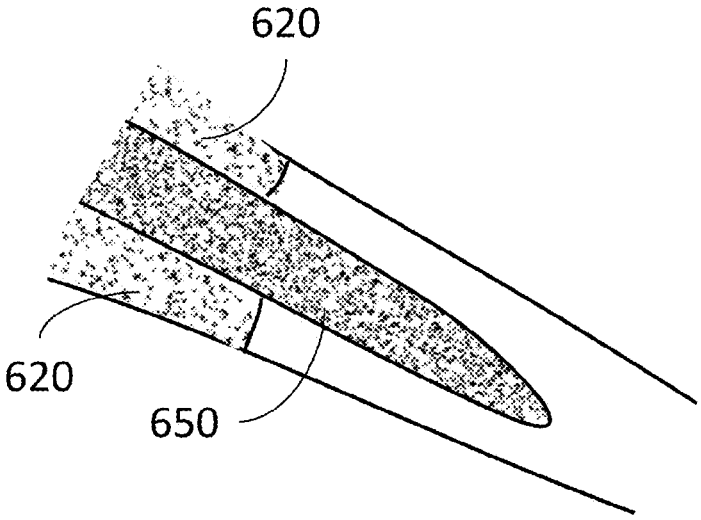
FIG. 6*c* illustrates a sectional view of FIG. 6*a* taken along XX.

FIGS. 6*a*-6*c* illustrate another embodiment of the golf tee. FIG. 6*a* illustrates a plan view of an embodiment of the subject golf tee wherein the golf tee comprises divots containing a higher concentration of spark inducing substance, shown generally at 610. FIG. 6*b* illustrates a top view of the tee of FIG. 6*a*. FIG. 6*c* illustrates a sectional view of FIG. 6*a* taken along XX. Referring to FIGS. 6*a*-6*c*, golf tee 610 includes a top plate 611 with a top wall 611*a* and side walls 611*b*. Top plate 611 is fixedly attached to a shaft 612 terminating at a point 613. A contact alert coating 620 is applied to at least an upper portion of the golf tee 610. Contact alert coating 620 is preferably a coating that generates a spark upon forceful contact of a golf club when it strikes the ball and contacts golf tee 610 at the coating/golf tee interface. A divot 650 holding more powder for enhancing the spark or contact alert is provided (see cross-section XX (see FIG. 6*c*)). The divot 650 may further project slightly from the tee body as a dart to stabilize the tee in the ground, while increasing chances for spark ignition.

Advantages are realized through manufacture of the spark inducing golf tee and method of using same to promote proper golfing form. These and other advantages include, for example:

1) empowers golfers to improve his/her golf swing in a very inexpensive manner;
2) provides entertainment and added excitement on the golf course;
3) conveys immediate feedback to a golfer which provides confirmation that a proper swing hit has taken place;
4) provides a low cost, reliable and effective means for improving golf posture and swing carry through;
5) improves confidence of the golfer during a golf round; and
6) provides a minimally invasive, readily discernible, quick method of improving golf swing.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A golf tee in a golf training system comprising a golf ball and a golf club, said golf tee having a contact alert coating for use with a golf ball and a golf club, comprising:

a) a golf tee body having a top plate with a top wall and side walls, said top plate being fixedly attached to a shaft that terminates into a point, said point and a portion of said shaft being appointed to be inserted into a ground surface when a golfer is getting ready to tee off and a golf ball is placed on said top wall of said top plate;
b) said contact alert coating being applied to at least an upper portion of said golf tee body;
c) said golf tee being present with said golf ball and said golf club;

d) said contact alert coating being composed of a combustible material that is appointed to generate an alert during a golf swing when a head of a golf club strikes said ball and said contact alert coating of said golf tee at the coating/golf tee interface, said alert being provided immediately as instantaneous feedback during said golf swing thereby improving muscle memory required to reliably replicate a proper golf swing;

e) said contact alert coating being located on at least a portion of said top plate but not located on said ball and not located on said head of said golf club each of which golf ball and said head of said golf club remains unadulterated; and f) said contact alert coating having a depth ranging from about 0.001 inches to 1.0 inches in depth;

g) said contact alert coating being composed of a material that generates a spark upon contact with said golf club head as said club head strikes said ball and contacts said contact alert coating of said golf tee at the coating/golf tee interface;

whereby said golf tee is appointed for use with a golf ball and golf club that do not have a contact alert coating thereon, and said contact alert coating located on said golf tee generates an alert when struck by a golf club head, thereby immediately informing the user whether the user's golf swing has been properly executed.

2. A golf tee in a golf training system comprising a golf ball and a golf club, said golf tee having a contact alert coating as recited by claim 1, wherein said contact alert coating is a material that is appointed to generate a sound upon contact with said golf club head as said club head strikes said ball and contacts said contact alert coating of said golf tee at the coating/golf tee interface.

3. A golf tee in a golf training system comprising a golf ball and a golf club, said golf tee having a contact alert coating as recited by claim 1, wherein said contact alert coating is located on at least a portion of said side walls of said top plate.

4. A golf tee in a golf training system comprising a golf ball and a golf club, said golf tee having a contact alert coating as recited by claim 3, wherein said contact alert coating is located on said side walls of said top plate and substantially coats said side walls.

5. A golf tee in a golf training system comprising a golf ball and a golf club, said golf tee having a contact alert coating as recited by claim 1, wherein said contact alert coating is located on and substantially coats said top plate.

6. A golf tee in a golf training system comprising a golf ball and a golf club, said golf tee having a contact alert coating as recited by claim 1, wherein said contact alert coating is located on at least a portion of said top wall of said top plate.

7. A golf tee in a golf training system comprising a golf ball and a golf club, said golf tee having a contact alert coating as recited by claim 1, wherein said contact alert coating is located on at least a portion of said shaft.

8. A golf tee in a golf training system comprising a golf ball and a golf club, said golf tee having a contact alert coating as recited by claim 1, wherein said contact alert coating is composed of at least one material that is appointed to generate a spark and at least one material that is appointed to generate a sound upon contact with said golf club head as said golf club strikes said ball and contacts said contact alert coating of said golf tee at the coating golf tee interface.

9. A golf tee in a golf training system comprising a golf ball and a golf club, said golf tee having a contact alert coating as recited by claim 1, wherein said contact alert coating has a depth ranging from about 0.003 inches to 0.5 inches in depth.

10. A golf tee in a golf training system comprising a golf ball and a golf club, said golf tee having a contact alert coating as recited by claim 1, wherein said contact alert coating has a depth ranging from about 0.01 inches to 0.05 inches in depth.

11. A golf tee in a golf training system comprising a golf ball and a golf club, said golf tee having a contact alert coating as recited by claim 2, wherein said contact alert coating further comprises a coloring to generate different color sparks.

12. A golf tee in a golf training system comprising a golf ball and a golf club, said golf tee having a contact alert coating as recited by claim 2, wherein said material composing said contact alert coating comprises ground-up asphalt.

13. A golf tee in a golf training system comprising a golf ball and a golf club, said golf tee having a contact alert coating as recited by claim 2, wherein said material composing said contact alert coating comprises small metallic pieces.

14. A golf tee in a golf training system comprising a golf ball and a golf club, said golf tee having a contact alert coating as recited by claim 2, wherein said material composing said contact alert coating is adapted to generate a spark when contacted by the head of a golf club swung at speeds ranging from about 70 to 120 mph.

15. A golf tee in a golf training system comprising a golf ball and a golf club, said golf tee having a contact alert coating as recited by claim 1, wherein said contact alert coating includes a water-resistant coating.

16. A golf tee in a golf training system comprising a golf ball and a golf club, said golf tee having a contact alert coating as recited by claim 15, wherein said water resistant coating comprises an ultra thin film layer of a wax, paraffin or polymeric material that is adapted to immediately rupture to provide contact to said contact alert coating upon contact with said golf club head.

17. A golf tee in a golf training system comprising a golf ball and a golf club, said golf tee having a contact alert coating as recited by claim 1, wherein said golf tee comprises a spiral shaped body portion.

18. A golf tee in a golf training system comprising a golf ball and a golf club, said golf tee having a contact alert coating as recited by claim 1, comprising divots for enhancing said spark.

19. A golf tee in a golf training system having a golf club and a golf ball capable of encouraging proper golfing form, comprising:

a) a golf tee body having a top plate with a top wall and side walls, said top plate being fixedly attached to a shaft that terminates into a point, said point and a portion of said shaft being appointed to be inserted into a ground surface when a golfer is getting ready to tee off and a golf ball is placed on said top wall of said top plate;

b) a contact alert coating applied to at least an upper portion of said golf tee body;

c) said golf tee being present with said golf ball and said golf club;

d) said contact alert coating being composed of a combustible material that is appointed to generate an alert during a golf swing when a head of a golf club strikes said ball and said contact alert coating of said golf tee at the coating/golf tee interface, said alert being provided immediately as instantaneous feedback during said golf swing thereby improving muscle memory required to reliably replicate a proper golf swing;

e) said contact alert coating being located on at least a portion of said top plate but not located on said ball and not located on said head of said golf club each of which golf ball and said head of said golf club remains unadulterated;

f) said contact alert coating having a depth ranging from about 0.001 inch to 1.0;

g) said contact alert coating being composed of a material that generates a spark upon contact with said golf club head as said club head strikes said ball and contacts said contact alert coating of said golf tee at the coating/golf tee interface;

whereby said golf tee is appointed for use with said golf club head and golf ball that do not have a contact alert coating, and said contact alert coating located on said golf tee generates an alert when struck by said uncoated golf club head, thereby immediately informing the user whether the user's golf swing has been properly executed.

20. A golf tee having a contact alert coating as recited by claim 1, comprising a dart that projects from the tee body and that holds more powder for enhancing said spark.

* * * * *